US007028676B2

(12) United States Patent
Regazzi et al.

(10) Patent No.: US 7,028,676 B2
(45) Date of Patent: Apr. 18, 2006

(54) INDUCTIVE IGNITION SYSTEM FOR INTERNAL COMBUSTION ENGINES

(75) Inventors: Gianni Regazzi, Funo Di Argelato (IT); Beniamino Baldoni, Bologna (IT)

(73) Assignee: Ducati Energia S.p.A., Bologna (IT)

( * ) Notice: Subject to any disclaimer, the term of this patent is extended or adjusted under 35 U.S.C. 154(b) by 0 days.

(21) Appl. No.: 11/110,804

(22) Filed: Apr. 21, 2005

(65) Prior Publication Data

US 2005/0257782 A1 Nov. 24, 2005

(30) Foreign Application Priority Data

May 21, 2004 (IT) ..... MI2004A1015

(51) Int. Cl.
*F02P 3/08* (2006.01)

(52) U.S. Cl. ..... 123/559; 123/603; 123/631; 123/149 R

(58) Field of Classification Search ..... 123/599–601, 123/604, 617, 621, 630–632, 650–654, 149 R, 123/149 A, 149 D
See application file for complete search history.

(56) References Cited

U.S. PATENT DOCUMENTS 4,862,862 A * 9/1989 Machida et al. ..... 123/609
5,220,902 A 6/1993 Caumont ..... 123/631
5,931,137 A * 8/1999 McLeod et al. ..... 123/406.57
6,662,792 B1 * 12/2003 Dutt et al. ..... 123/598
6,766,787 B1 * 7/2004 Kihlberg et al. ..... 123/406.57
6,779,517 B1 * 8/2004 Sakakura ..... 123/630
6,814,055 B1 * 11/2004 Kihlberg et al. ..... 123/406.57
6,814,056 B1 * 11/2004 Suzuki ..... 123/406.57
6,889,677 B1 * 5/2005 Fujima et al. ..... 123/600
2004/0107950 A1 * 6/2004 Masaoka et al. ..... 123/631
2005/0172939 A1 * 8/2005 Masaoka et al. ..... 123/603

FOREIGN PATENT DOCUMENTS

EP 0 529 735 3/1993

* cited by examiner

*Primary Examiner*—Hai Huynh
(74) *Attorney, Agent, or Firm*—Young & Thompson

(57) ABSTRACT

The ignition system for internal combustion engines includes a rotor and an armature having an ignition coil in which voltage signals, each having pulses of opposite polarities are cyclically induced during each rotor revolution; a control unit for the ignition current includes a current-control switch which can be triggered during a positive pulse of the voltage signals, to cut off the current in the primary winding and generate a high voltage on the secondary winding of the ignition coil. A second control switch has the control electrode connected to a current-control resistor in series with the current-control switch, and to the outlet of a voltage comparator connected to a timing circuit enabling the sparking within a pre-established time interval, preventing sparking when the engine is running below a minimum rotational speed, during the forward rotation and at the reverse rotation of the same engine.

8 Claims, 4 Drawing Sheets

INDUCTIVE IGNITION SYSTEM FOR INTERNAL COMBUSTION ENGINES

BACKGROUND OF THE INVENTION

This invention refers to an inductive ignition system for low-powered internal combustion engines, such as engines of 50–80 cc, for example used for chain saws, lawnmowers, bush-cutters and similar applications.

PRIOR ART

An inductive ignition system, for low-powered engines of the aforementioned kind, usually comprises a voltage magneto-generator including a rotor provided with a permanent magnet, and two pole pieces which extend on the sides of the magnet by a pre-established angle along a peripheral edge of the same rotor; the magneto generator also comprises a U-shaped stator armature, provided with an ignition coil including a primary and a secondary windings connected respectively to an electronic control circuit and to an ignition spark plug.

In ignition systems of this kind, at each revolution of the rotor, a variable magnetic flux is generated in the stator armature of the voltage generator, with the consequent generation of a voltage signal consisting of a set of four alternately positive and negative pulses, and the circulation of an AC current in the primary winding of the ignition coil.

The sudden sharp interruption of the ignition current, by means of an electronic controlled switch, induces a high voltage pulse in the secondary winding of the ignition coil and a consequent sparking of the ignition spark plug.

The OFF state of the control switch to interrupt the current, usually is achieved by means of two control systems: by means of an inductive pickup which, on detection of the passage of the magnet during the revolutions of the rotor, provide a control signal to the electronic control unit, or by providing a control signal in the form of a voltage drop in a resistor when the current of the primary winding is flowing through the same resistor of a control unit.

An ignition system usually is also provided with a "STOP" switch to stop the engine, by connecting a terminal of the primary winding to earth, thereby hindering the possibility of generating the ignition sparks.

Most of the inductive ignitions for small or low-powered combustion engines, currently available on the market, are provided with an ON-OFF control system of the type mentioned above.

Very often it is necessary to provide additional functions for specific application requirements: for example it may be necessary to have a control of the rotational speed of the engine at which the ignition begins to spark, usually known as "cut-in speed"; it may also be required to prevent the sparking during a reverse rotation of the engine until reaching a pre-established rotational speed, normally 1000 revolutions per minute (r.p.m.).

In this connection, solutions capable of performing the aforesaid functions have already been proposed, for example in EP-A-0 529 735, or in the corresponding U.S. Pat. No. 5,220,902; such solution, in addition to being particularly complex, does not allow an adequate control of the minimum speed of the engine at which the ignition begins to spark, whenever use is made of an integrated electronic circuit.

OBJECTS OF THE INVENTION

The main object of this invention is to provide an electronic ignition system for internal combustion engines, of the aforementioned kind, characterised by structural simplicity.

A further object of the invention is to provide an electronic ignition system capable of offering a satisfactory reliability degree and in which use is made of an integrated electronic circuit whereby it is possible to ensure a high precision degree in controlling the minimum speed of the engine at which the ignition begins to spark, both during forward and reverse rotations.

BRIEF DESCRIPTION OF THE INVENTION

According to the invention an inductive ignition system has been provided, comprising:

a stator provided with an ignition coil having a primary winding connected to an ignition-current circuit comprising a first current-control switch, and a secondary winding connected to a spark plug;

a rotor having a magnet to cyclically produce into the stator, a variable magnetic flux during each revolution to induce into the primary winding of the ignition coil, voltage signals each comprising four voltage pulses alternately of opposite polarities, and for the circulation of an ignition current in the primary winding circuit;

a first control circuit comprising a current-control resistor connected in series to the current-control switch;

a second control switch having a control electrode connected between the current control resistor and the current-control switch to trigger the latter by turning ON and OFF the same;

a second control circuit being provided to control the minimum rotational speed at which spark the engine;

characterised in that:

the second control circuit comprises a voltage comparator having an open-collector outlet connected to the control electrode of the second control switch, a reversing inlet of the voltage comparator being connected to a first reference-voltage circuit, a non reversing inlet of the voltage comparator being in turn connected to a timing circuit;

the timing circuit comprising a timing capacitor to provide the non reversing inlet of the voltage comparator with a second inlet voltage higher than the first reference voltage, at each charging of the timing capacitor, in a time at least equal to a time necessary for rising the current flowing in the current-control resistor at a value for triggering the second control switch, causing the turning OFF of current-control switch upon reaching said minimum rotational speed, to spark the engine.

The voltage comparator is connected to a feeding circuit comprising a capacitor having a positive terminal connected to the earth, and a negative terminal connected, by a diode, to a terminal of the primary winding of the ignition coil; and in which the reversing inlet of the voltage comparator is connected to a voltage divider, supplying the voltage comparator with a reference voltage corresponding to a fraction of the voltage of the feeding circuit; the non-reversing inlet of the voltage comparator being in turn connected to a connection point between a resistor of the voltage divider and the timing capacitor, and in which the charging time of the timing capacitor depends on the minimum rotational speed of the engine at which the sparking or the activation of the ignition circuit occurs.

The charging time of the timing capacitor, during the forward rotation of the engine, is equivalent to or higher than the time between the end of the discharge of the timing capacitor during the first negative pulse of each voltage signal, and the time at which the triggering voltage is reached on the control electrode of the current control switch during a subsequent positive pulse of the same voltage signal.

Conversely, the charging time of the timing capacitor, during the reverse rotation of the engine, is equivalent to or higher than the time between the end of the discharge of the capacitor during the second negative pulse of a voltage signal of the generator, and the time at which the triggering voltage is reached on the control electrode of the current-control switch, during the first positive pulse of the voltage signal following the first one.

BRIEF DESCRIPTION OF THE DRAWINGS

These and further features of the ignition system according to the invention, will be more clearly evident from the following description, with reference to the accompanying drawings, in which.

DETAILED DESCRIPTION OF THE INVENTION

Figure 1:
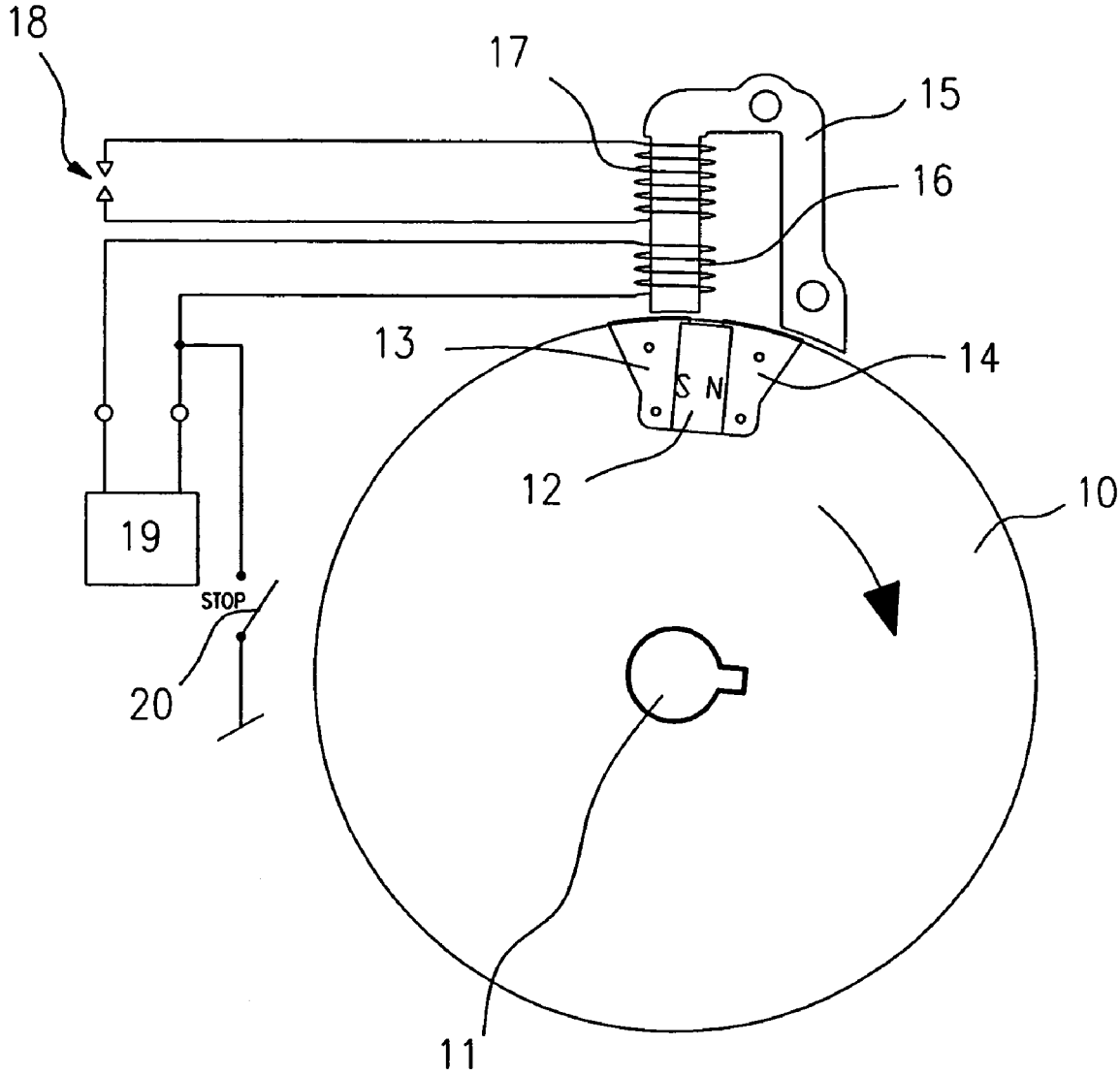
FIG. 1 schematically shows an ignition system according to the invention.

As shown in FIG. 1, the ignition system comprises a fly-wheel rotor 10 operatively connected to a shaft 11 of an internal combustion engine; the rotor 10 is provided with a permanent magnet 12 magnetised in a cross direction, and pole pieces 13 and 14 on both sides of the magnet 12, to provide a magnetic flux which extend on a certain angle at the peripheral edge of the rotor 10.

The ignition system also comprises a U-shaped stator armature 15 facing the rotor 10, and an ignition coil comprising a primary winding 16 and a secondary winding 17 which are wound on and magnetically linked by a leg of the armature 15.

An ignition spark plug 18 is connected to the secondary winding 17, while an electronic control unit 19 is connected to an earth terminal "GND" and to a voltage terminal "STOP" of the primary winding 16, connected to a STOP switch 20 for short-circuiting to earth the primary winding 16 for stopping the engine.

Figure 4:
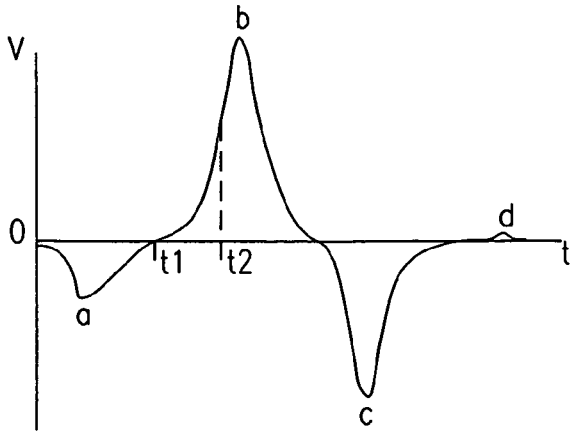
FIG. 4 shows a voltage diagram of the voltage generator, during the forward rotation of the engine.
Figure 5:
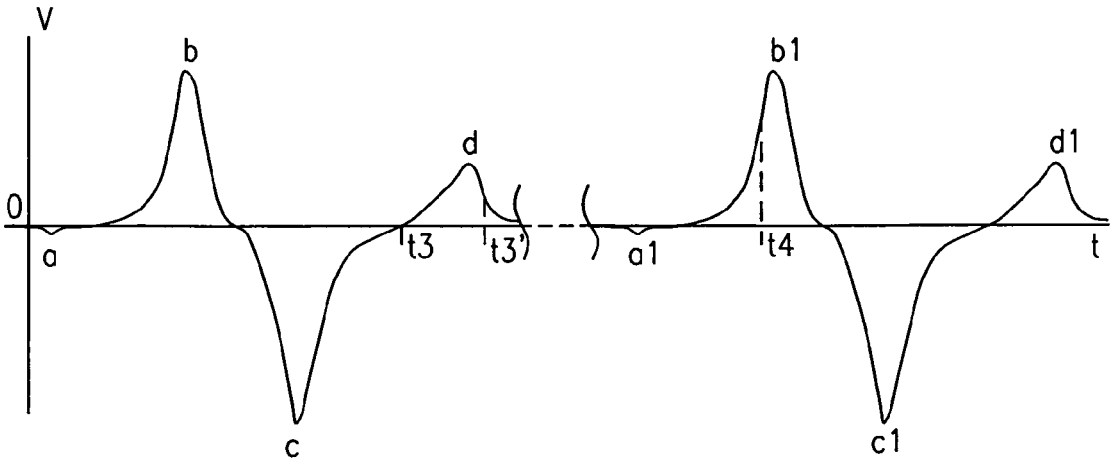
FIG. 5 shows a voltage diagram of the voltage generator during the reverse rotation of the engine.

The particular conformation of the voltage signals, detectable on the primary winding 16 of the ignition coil, depends on the specific shape of the stator armature 15; the voltage signals are shown in FIG. 4 for the forward rotation of the engine, and in FIG. 5 for the reverse rotation.

As can be seen in these figures, each voltage signal comprises a set of four pulses of different amplitude, comprising two negative pulses "a" and "c" and two positive pulses "b" and "d" which are selectively used during the rotation of the rotor for supplying power to the system, and respectively for supplying the power necessary for sparking the ignition circuit.

Figure 2:
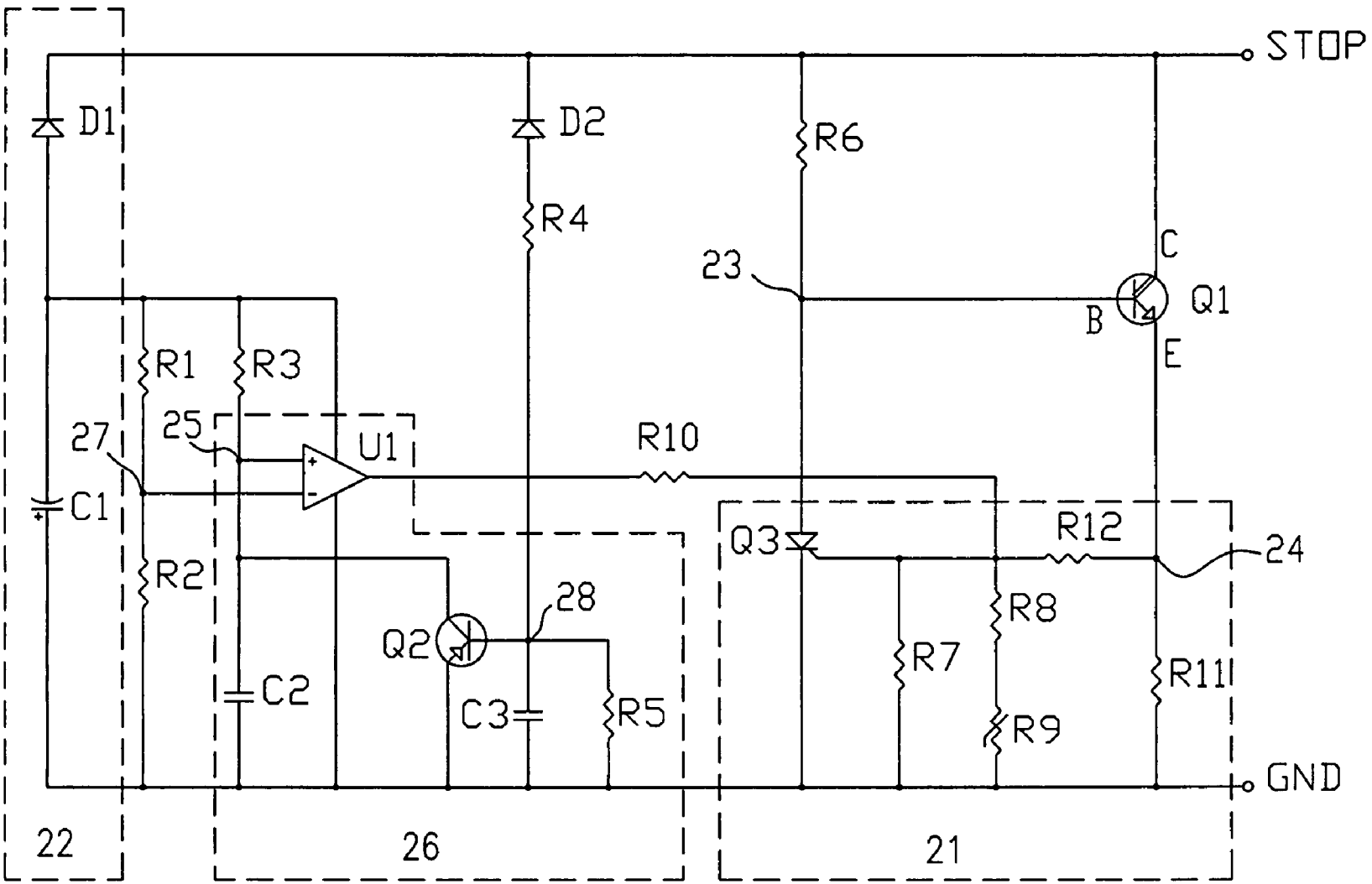
FIG. 2 shows a first embodiment of the electronic control unit.

FIG. 2 of the accompanying drawings shows a preferential embodiment of the electronic control unit 19.

The control unit 19 comprises a first electronic current cut-off switch Q1, having the collector-emitter circuit C, E, connected between the voltage terminal "STOP" and the earth terminal "GND", by means of a current-control resistor R11 being part of a first control circuit 21 for controlling the ignition current, as described further on.

The current-control switch Q1 must be triggered to suddenly interrupt or cut-off the current flowing through the primary winding 16 of the ignition coil, in order to generate in the secondary winding 17 a high voltage capable of causing the sparking between the electrodes of the ignition spark plug 18.

According to this first embodiment, the current-control switch Q1 comprises a "trillington" namely composed of three transistors connected in cascade like a "Darlington" which, in addition to having a high gain, for example Hfe=10000 for a current of 2 Amp, does not contain the usual diode between the emitter E and collector C, with the anode on the emitter E.

Thanks to its high gain, the base B of the switch Q1 can be biased directly by a resistor R6 of a high value, ranging for example between 1000 and 2000 Ohm.

The current-control switch Q1, during the negative pulses "a" and "c" in the forward rotation, and during the negative pulse "c" in the reverse rotation of the engine, is biased with the emitter E positive with respect to the collector C; therefore, in this condition the switch Q1 has a breakdown voltage ranging from 12 to 18 Volts, behaving in practice like a Zener diode; this breakdown voltage will be hereinafter referred to as Zener voltage.

This feature of the current-control switch Q1 is utilised to selectively obtain the sparking and the feeding of the entire ignition system.

To this purpose, as shown in FIG. 2, reference number 22 has been used to indicate a feeding circuit comprising a capacitor C1 and a diode D1, in which the positive terminal of the capacitor C1 is connected to the earth GND, and in which the diode D1 is forward biased in respect to the STOP terminal and towards the collector C of current-control switch Q1.

Still with reference to FIG. 2, it can be seen that the base B of the switch Q1 is connected to the point 23 between a biasing resistor R6 and a second electronic control switch Q3, substantially consisting of an SCR; the second control switch Q3 serves to trigger the turning ON and OFF, of the current-control switch Q1 for the interruption of the ignition current into the primary winding circuit 16.

More precisely, the control switch Q3 is biased towards the terminal GND so as to conduct current during the positive voltage pulses. The control electrode of Q3 in turn is connected, through the resistor R12, to an intermediate connection point 24 between the current-control switch Q1 and the current-control resistor R11.

The circuit 21 for controlling the current in the primary winding 16 of the ignition coil is completed by a voltage divider comprising the resistors R7, R8, and R9, of which the resistor R9 consists of a negative coefficient thermistor NTC, whereby it is possible to achieve a thermal compensation of the variation in the triggering voltage of the control electrode of the switch Q3, which would tend to decrease as the temperature increases, thereby maintaining the required value of the voltage drop in the resistor R11 and, consequently, the value of the current which triggers the switch Q3 substantially constant as the temperature changes.

The ignition system is completed by a speed control circuit for controlling the minimum speed of rotation of the engine at which the ignition is activated to spark the engine.

The circuit for controlling the minimum rotational speed of the engine substantially comprises a timing circuit 26 and a voltage comparator U1 having an open-collector outlet connected to the control electrode of the second switch Q3, by means of the resistor R10.

The reversing inlet (−) of the voltage comparator U1 is connected to the intermediate point 27 of a voltage divider R1, R2 to be fed with a reference voltage equivalent to a fraction of the voltage of the feeding circuit 22.

The non-reversing inlet (+) of the voltage comparator U1, in turn is connected to the connection point 25 between a resistor R3 and a second capacitor C2 forming part of the timing circuit 26 for the voltage comparator U1.

The timing circuit 26, in the case shown, comprises a third control switch Q2, for example a transistor PNP directly biased by the negative pulses of the voltage signals, to allow the discharge of the capacitor C2 during a negative pulse of the voltage signals, as explained further on.

The base of the electronic switch Q2 is connected to the connection point 28 of a filter R4, R5, C3 comprising a diode D2 directly biased towards the STOP terminal.

The ignition system, in the case of forward rotation of the engine, functions as follows: the switch Q1 for cutting off the ignition current, during the negative pulses "a" and "c" of each voltage signal, is biased with the emitter E positive with respect to the collector C; therefore in this condition it has a Zener voltage as mentioned previously, capable of limiting the charging voltage of the capacitor C1 of the feeding circuit 22.

During the negative pulses of each voltage signal the capacitor Cl, having a capacity ranging for example from 20 to 100 microfarad, and a charging voltage higher than the Zener voltage of Q1, is charged with the positive pole connected to the terminal GND of the primary winding of the ignition coil, until it reaches the maximum voltage imposed by the Zener voltage of the switch Q1; subsequently, the capacitor C1 will be able to feed the voltage comparator U1, the resistors R1, R2 and charge the capacitor C2 by means of the resistor R3, for as long as the voltage signal of the primary winding 16 of the ignition coil is positive or null.

In fact, during the positive pulse "b" the base "B" of Q1 is polarised by means of the resistor R6, and consequently the switch Q1 can conduct current from the collector C to the emitter E and towards the current-control resistor R11.

This current, also referred to as ignition current, through the resistor R11 causes in the latter a voltage drop which, by means of the resistive divider of the current control circuit 21, consisting of the resistors R12, R7, R8 and the thermistor NTC R9, is fed to the control electrode of the switch Q3.

By appropriately calculating the resistive values of these components, it is possible to achieve a thermal compensation of the change in the triggering voltage of the control electrode of Q3, which tends to decrease as the temperature increases; in this way it is possible to maintain a constant value of the voltage drop in the current-control resistor R11, and therefore the value of the current flowing through the resistor R12 towards the control electrode of Q3 as the temperature changes.

The turning ON of the switch Q3 as a result of the circulation of the ignition current through the current-control resistor R11, in turn gives rise to the passage of a current and a consequent voltage drop through the biasing resistor R6 which leads to the turning OFF of the switch Q1, and consequently the rapid cut-off of the ignition current flowing through the primary winding 16 of the ignition coil; a high voltage will consequently be generated in the secondary winding 17 which will cause a sparking in the spark plug 18.

The switch Q3, by means of the resistor R6, remains turned ON until the positive voltage of the pulse "b" decreased to zero, after which the switch Q3 is turned OFF and prepares the system for the subsequent voltage signal.

Let us now consider the control of the minimum rotational speed of the engine at which the ignition is activated, also referred to as cut-in speed, and the protection of the ignition system against the reverse rotation of the engine.

In the low-powered two-stroke engines, for safety reasons it is preferable not to have sparks below a pre-established minimum rotational speed, for example below 1000 r.p.m.

Consequently, with reference to the diagram of FIG. 4, in the case of forward rotation, during the first negative pulse "a" the base of the switch Q2 is biased directly by means of R5, C3, R4 and D2; therefore Q2 conducts from the emitter towards the collector thereby discharging the timing capacitor C2 connected to the non-reversing inlet (+) of the voltage comparator U1, whose reversing inlet (−) is connected to the connection point 27 between the resistors R1, R2 of the voltage divider; in this way the reversing inlet of U1 is biased at a fraction of the voltage of C1.

At the end of the first negative pulse "a" the capacitor C2 can thus be charged again through the resistor R3.

Throughout the period of time in which the voltage on the non-reversing inlet of the voltage comparator U1 is higher than the reference voltage on the reversing inlet, the open collector transistor outlet of the voltage comparator U1 is open since in this case it has no effect on the triggering of the switch Q3.

The charging voltage of the capacitor C2 gradually increases until the voltage on the reversing inlet of the comparator U1 exceeds the reference voltage at the non-reversing inlet, bringing the outlet transistor of the comparator U1 into a conductive state, thereby putting the negative terminal of the capacitor C1 into connection with the resistor R10. This negative voltage is applied to the control electrode of the switch Q3; in fact, the conduction of Q3 and consequently the interdiction of the switch Q1 will be prevented, thereby inhibiting the sparking of the ignition.

With reference to FIG. 4 and the voltage generator of FIG. 1, the angle of rotation of the rotor 10 between the time t1 corresponding to the end of the negative pulse "a", and the time t2 at which the right level of the ignition current in the current-control resistor R11 is reached, in correspondence with the first positive voltage pulse "b", can be estimated as approximately 30°, depending upon the rotational speed of the engine; this angular distance will correspond to a time interval delta t equivalent to t2–t1.

Therefore, whenever it is required that the ignition system enables the sparking of the plug 18 only for speeds higher than a pre-established minimum value, the time interval delta t necessary for the current flowing through the primary winding 16 to reach the desired value, must be equivalent to or less than the time interval during which the timing capacitor C2 must charge at the required fraction of the feeding voltage of the capacitor C1, determined by the resistive divider R1, R2.

In other words, the switch Q3 will be enabled to trigger only during a time interval delta t starting from the end of the first negative half wave "a"; if, during this time, the current in the current-control resistor R11 reaches the right value for triggering the switch Q3, ignition will take place. On the contrary, if the value of the current in R11 is reached after the time interval delta t, then the outlet transistor of the voltage comparator U1 will be OFF, bringing the control electrode of the switch Q3 to a negative voltage, preventing the sparking of the ignition spark plug.

The second positive half wave "d", during the forward rotation of the engine is wholly negligible in that it does not have a high enough energy content to allow the flowing of a current sufficient to reach the operation threshold of the switch Q3, while in the reverse rotation the first negative half wave "a" is filtered by the filter consisting of R4, R5 and C3 and consequently is unable to trigger the switch Q2; in both cases, these pulses are non-influential for the operation of the ignition system.

Now let us consider the condition of reverse rotation shown in the diagram of FIG. 5 and again consider the case of a minimum rotational speed of the engine below which ignition must be prevented. Unlike the case of FIG. 4, in the case of reverse rotation, FIG. 5 shows two diagrams of immediately subsequent voltage signals, as a result of a complete turn of the rotor 10, which are spaced apart from each other by a time interval proportional to the angular space equivalent to 360° less the maximum angle existing between the two pole pieces 13 and 14 of the rotor 10.

In this case, when the rotor turns in the reverse rotation, or in the direction opposite to that of the arrow in FIG. 1, the capacitor C2 is discharged during the negative pulse "c" of the first voltage signal; therefore during the time interval delta t=t3'–t3 corresponding to that for the forward rotation, it would be possible to trigger the switch Q3 on the positive pulse "d"; however, since this pulse is very weak, a sufficiently high current value to trigger the switch Q3 will never be reached, thereby preventing generation of the sparking in the ignition spark plug.

Conversely, the positive pulse "b1" of the following voltage signal would be capable of generating a sufficient passage of current to trigger the switch Q3 but, due to the reverse rotation of the rotor, it will be at a greater angular space, compared to the case of the forward rotation of FIG. 4, equivalent to the difference existing between the entire angle of rotation of the rotor 10 and the previous angular distance necessary to reach the right level of current in the resistor R11 during forward rotation. Therefore, in this case the positive pulse "b1" could be able to generate a current sufficient to trigger the switch Q3, in the delta t interval, but at a considerably higher speed of rotation of the engine, for example three or four times higher than the minimum speed, which can never be reached.

Figure 3:
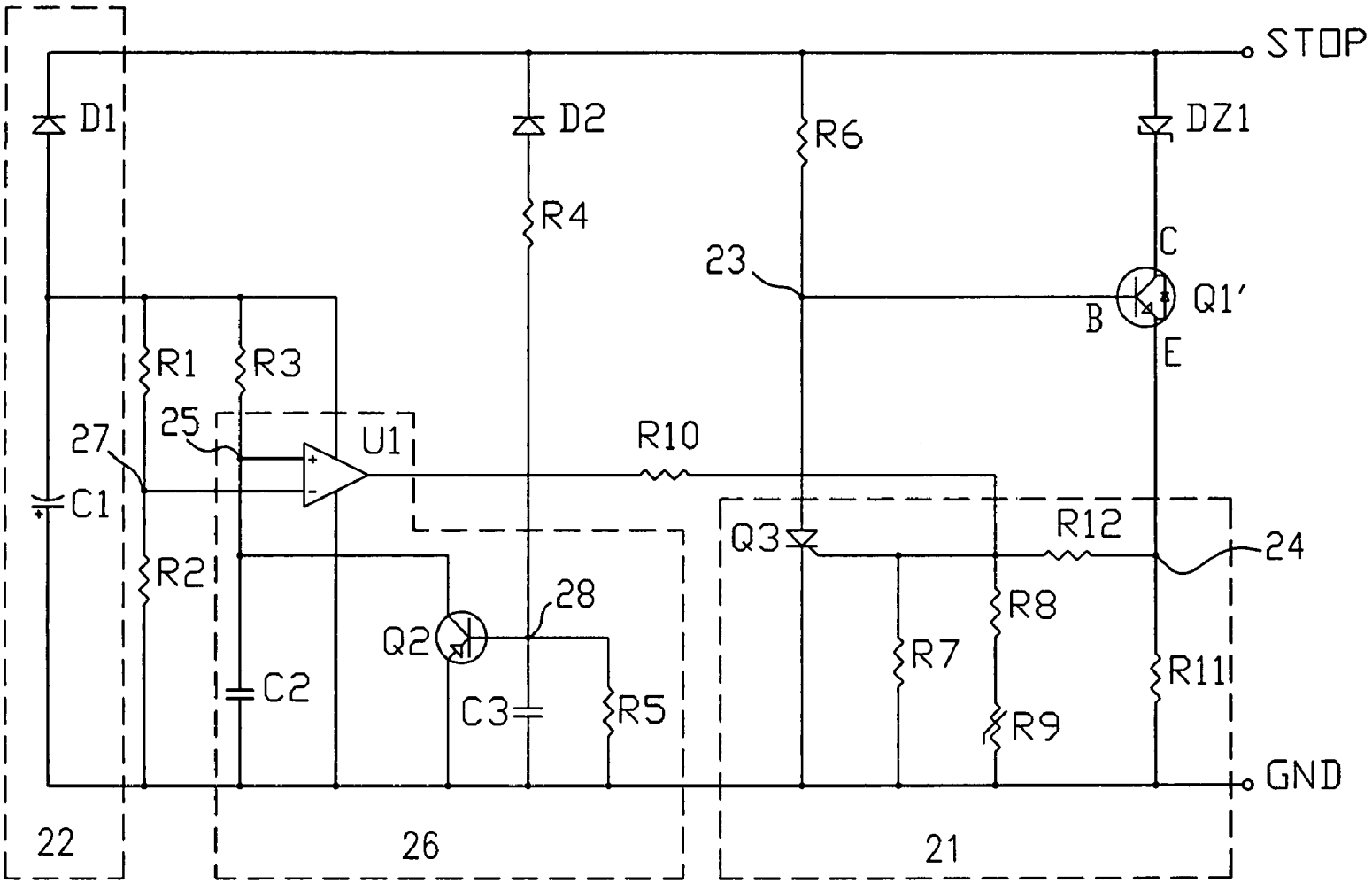
FIG. 3 shows a second embodiment of the electronic control unit.

FIG. 3 of the accompanying drawings shows a possible second embodiment of the ignition system, which substantially consists in substituting the trillington Q1 of the example of FIG. 2, with a Darlington Q1' having a diode Zener DZ1 connected in series to the collector C; the switch Q1' with the Zener DZ1 performs the same function as the trillington switch Q1 of FIG 1.

For the remaining, the example of FIG. 3 operates in a wholly identical way to the example of FIG. 2; consequently also in FIG. 3 the same reference numbers as FIG. 2 have been used to indicate similar or equivalent parts.

It is understood that what has been described and shown with reference to the accompanying drawings, has been given purely in order to illustrate this invention and some of its preferential embodiments; therefore other modifications or variations may be made without thereby deviating from the scope of the claims.

What we claim is:

1. An inductive ignition system comprising:

a stator provided with an ignition coil having a primary winding connected to an ignition-current circuit comprising a first current-control switch, and a secondary winding connected to a spark plug;

a rotor having a magnet to cyclically produce into the stator, a variable magnetic flux during each revolution to induce into the primary winding voltage signals, each comprising four voltage pulses alternately of opposite polarities, and for the circulation of an ignition current in the primary winding circuit;

a first control circuit comprising a current-control resistor connected in series to the current-control switch;

a second control switch having a control electrode connected between the current control resistor and the current control switch to trigger the latter by turning ON and OFF the same;

a second control circuit being provided to control the minimum rotational speed at which spark the engine;

the second control circuit comprising a voltage comparator having an open-collector outlet connected to the control electrode of the second control switch, a reversing inlet of the voltage comparator being connected to a first reference voltage circuit, a non reversing inlet of the voltage comparator being in turn connected to a timing circuit;

the timing circuit comprising a timing capacitor to provide the non reversing inlet of the voltage comparator with a second inlet voltage higher than the first reference voltage, at each charging of the timing capacitor, in a time at least equal to a time necessary for rising the current flowing in the current-control resistor at a value for triggering the second control switch, causing the turning OFF of current-control switch upon reaching said minimum rotational speed, to spark the engine.

2. The ignition system according to claim 1 wherein the voltage comparator is connected to a feeding circuit comprising a capacitor having a positive terminal connected to earth and the negative terminal connected, through a diode, to a voltage terminal of the primary winding of the ignition coil, characterised in that the reversing inlet of the voltage comparator is connected to a voltage divider providing a reference voltage corresponding to a fraction of the voltage of the feeding circuit; the non-reversing inlet of the voltage comparator being in turn connected to the connection point between the timing capacitor and said voltage divider, and in that the charging time of the timing capacitor is related to the minimum rotational speed of the engine at which the sparking of the ignition will occur.

3. The ignition system according to claim 2, wherein the charging time of the timing capacitor during the forward rotation of the engine, is equivalent to or longer than the time between the end of the discharge of the timing capacitor during the first negative pulse of each voltage signal, and the time for reaching the triggering voltage on the control electrode of the second control switch during the following positive pulse of a same voltage signal.

4. The ignition system according to claim 2, wherein the charging time of the timing capacitor, during the reverse rotation of the engine, is equivalent to or longer than the time between the end of the discharge of the timing capacitor during the second negative pulse of a voltage signal, and the time for reaching the triggering voltage on the control electrode of the second control switch during the first positive pulse of a voltage signal following the previous one.

5. The ignition system according to claim 2, wherein the feeding circuit comprises a capacitor, which is charged by the negative pulses of each voltage signal during the forward rotation of the engine.

6. The ignition system according to claim 2, wherein the capacitor of the feeding circuit is charged by the second negative pulse of each voltage signal during the reverse rotation of the engine.

7. The ignition system according to claim 1, wherein the current-control switch is a trillington devoid of diode between emitter-collector circuit, with emitter connected to the earth of the ignition coil.

8. The ignition system according to claim 1, wherein the current-control switch is a Darlington with a Zener diode in series having its anode connected to the voltage terminal of the ignition coil.

* * * * *